US006162015A

United States Patent [19]

Nagai et al.

[11] Patent Number: 6,162,015

[45] Date of Patent: Dec. 19, 2000

[54] CENTRIFUGAL TYPE FLUID MACHINE

[75] Inventors: Yuuji Nagai, Niiharai-gun; Yoshiharu Ueyama, Tsukuba; Setsuo Yazawa, Abiko; Sadashi Tanaka, Niihari-gun; Yoshihiro Nagaoka, Ishioka, all of Japan

[73] Assignee: Hitachi, Ltd., Tokyo, Japan

[21] Appl. No.: 08/913,253

[22] PCT Filed: Mar. 13, 1995

[86] PCT No.: PCT/JP95/00411

§ 371 Date: Sep. 10, 1997

§ 102(e) Date: Sep. 10, 1997

[87] PCT Pub. No.: WO96/28662

PCT Pub. Date: Sep. 19, 1996

[51] Int. Cl.[7] ..... F04D 29/02

[52] U.S. Cl. ..... 415/199.2; 415/208.3; 415/211.1; 415/199.3

[58] Field of Search ..... 415/199.2, 199.3, 415/208.3, 208.4, 211.1, 914

[56] References Cited

U.S. PATENT DOCUMENTS

| | | | |
|---|---|---|---|
| 4,938,661 | 7/1990 | Kobayashi et al. | 415/199.3 |
| 5,178,516 | 1/1993 | Nakagawa et al. | 415/208.3 |
| 5,595,473 | 1/1997 | Nagaoka et al. | 415/199.2 |

FOREIGN PATENT DOCUMENTS

| | | | |
|---|---|---|---|
| 0265389 | 11/1986 | Japan | 415/208.3 |
| 6415498 | 1/1989 | Japan . | |

OTHER PUBLICATIONS

Japanese Patent Unexamined Publication No. 61–258998, Nov. 17, 1986.

Japanese Patent Unexamined Publication No. 4–334798, Nov. 20, 1992.

*Primary Examiner*—Edward K. Look
*Assistant Examiner*—Richard Woo
*Attorney, Agent, or Firm*—Antonelli, Terry, Stout & Kraus, LLP

[57] ABSTRACT

A highly efficient centrifugal type fluid machine is configured so that the vane outlet angle or the vane outlet diameter at a side plate end (4*a*) of a single stage or a plurality of stages of a diffuser (D) is made larger than the vane outlet angle or the vane outlet diameter at a core plate end (4*b*), and the vane curve at a pressure surface end of a single stage or a plurality of stages of the diffuser (D) is formed to have the same radius of curvature at the side plate end (4*a*) and at the core plate end (4*b*), while the vane curve at a negative pressure surface end is formed to have a radius of curvature so that the vane thickness at the core plate end (4*b*) is larger than that at the side plate end (4*a*).

24 Claims, 13 Drawing Sheets

CENTRIFUGAL TYPE FLUID MACHINE

CROSS-REFERENCE TO RELATED APPLICATIONS

This is the national stage of International Application No. PCT/JP95/00411 filed Mar. 13, 1995.

FIELD OF THE INVENTION

The present invention relates to a multi-stage or single-stage centrifugal type fluid machine in which diffuser vanes are formed on a diffuser on the outer periphery of an impeller and, more particularly, to a centrifugal type fluid machine preferable for a boiler feed water pump and the like installed at a thermal power plant.

BACKGROUND ART

A diffuser having diffuser vanes is constituted by a side wall at a side plate end and another side wall at a core plate end of a radial impeller (hereinafter referred to simply as "impeller") and diffuser vanes. In a centrifugal type fluid machine having diffuser vanes, the diffuser is disposed such that the foregoing both side walls of the diffuser lie in a surface nearly perpendicular to a main shaft; and a radial diffuser is generally used, the radial diffuser allowing a high-velocity, radial, outward fluid which flows out of the impeller to flow out as it is in the radial direction. As the diffuser vanes, there are so-called "two-dimensional vanes" which have the same sectional shape from the side wall at the side plate end to the side wall at the core plate end constructing the diffuser. Ideally, a bent passage for guiding the fluid on the downstream side of the diffuser to a radial flow is formed to have a large radius of curvature. In a multi-stage centrifugal type fluid machine, however, allowing a large radius of curvature is disadvantageous in reducing the size of the machine in the direction of the radius and in the direction of the main shaft; therefore, the bent passage is composed of a rectangular passage which hardly has a radius of curvature.

The diffuser and the bent passage are good in the aspect of size reduction and economy of a fluid machine; on the other hand, however, a passage having an acute curve is disposed in the vicinity of an outlet of the diffuser and therefore, a force is applied to the curved portion in an oblique outward direction due to a change in the momentum which takes place when the upward flow in the radial direction is switched to a flow in the direction of the main shaft at the inlet of the bent passage. Hence, the flow in the vicinity of the outlet of the diffuser becomes a flow inclined toward the core plate rather than in the radial direction. As a result, the boundary layer of the surface along the side wall at the side plate end markedly develops, while the development of the boundary layer of the surface along the side wall at the core plate end becomes small because a main current approaches thereto. This trend becomes so marked that a handled flow rate is decreased below a design point, causing unstable characteristics (a drop in head-discharge curve) of a pump in a low flow rate zone. For this reason, a diffuser having so-called three-dimensional vanes has been developed to improve the unstable characteristics, to prevent a pump from becoming larger, and also to prevent pumping efficiency from being reduced, the diffuser having been disclosed in Japanese Patent Unexamined Publication No. 61-258998.

The diffuser vanes are shaped so that the spreading angle between the vanes is made smaller in a portion near the side wall at the side plate end, while the spreading angle between the vanes in a portion near the side wall at the core plate end is made larger. Hence, a rise in pressure due to the deceleration of the main stream flowing in the vicinity of the side wall of the side plate of the diffuser decreases so as to control the boundary layer which develops along the side wall at the core plate end, and the loss attributable to a secondary flow of the boundary layer is decreased and the separation of the flow on the side wall at the side plate end which takes place in the low flow rate zone is prevented.

In the diffusers having the two-dimensional or three-dimensional vanes, no consideration has been given to the flow of a fluid in the diffuser in the low flow rate zone or to the flow of a fluid which comes out of a multi-stage diffuser and passes through a bent passage. Regarding a flow on the downstream side of the diffuser, the flow passing the side plate of the diffuser moves along the outer side wall surface of the bent passage, therefore, the distance before reaching a return passage located further at the downstream side of the bent passage is prolonged, leading to an increased friction loss. The flow of the fluid passing the core plate of the diffuser moves along the inner side wall surface of the bent passage; the flow cannot move along the wall surface in the bent portion having a small radius of curvature and it separates, making it easy for the boundary layer to develop on the inner wall surface.

Thus, the loss due to the friction or separation deteriorates the performance of a centrifugal type fluid machine, and since the flow velocity of the fluid in a diffuser decreases in the low flow rate zone, the spreading angle between the vanes becomes relatively large; therefore, the fluid has been apt to flow back and the head-discharge curve has been exhibiting unstable characteristics.

An object of the present invention is to provide a centrifugal type fluid machine which permits higher efficiency by reducing the flow loss in a bent passage on the downstream side of a diffuser and by reducing the flow loss in the diffuser in a low flow rate zone in a multi-stage type one, and also by reducing the flow loss in the diffuser in the low flow rate zone in a single-stage type one.

DISCLOSURE OF THE INVENTION

To fulfill the foregoing object, a centrifugal type fluid machine in accordance with the present invention is provided with a radial impeller which is attached to a main shaft and which rotates together with the main shaft, a diffuser which is located on the outer periphery of the radial impeller and guides the flow of a fluid coming out of the radial impeller so that it is directed outward to recover static pressure, a diffuser vane formed on the diffuser, and a stage which forms a bent passage for guiding the outward flow coming out of the foregoing diffuser to an inward flow and a return passage for gathering inward the flow coming out of the bent passage and for guiding it to the inlet of a radial impeller of the next stage, which are mounted in multiple stages in the axial direction; wherein the diffuser vane is formed so that the vane outlet angle at the side plate end of a single stage or a plurality of stages of the diffuser is larger than the vane outlet angle at the core plate end.

Further according to the present invention, in order to fulfill the aforesaid object, the diffuser vane is formed so that the vane outlet diameter at the side plate end of the single stage or a plurality of stages of the diffuser is larger than the vane outlet diameter at the core plate end.

Furthermore, according to the present invention, in order to fulfill the above object, the vane curve at the pressure surface end of a single stage or a plurality of stages is formed so that the side plate end and the core plate end share the same radius of curvature, while the vane curve at the negative pressure surface end is formed to have a radius of curvature so that the vane thickness at the core plate end is larger than that at the side plate end.

Furthermore, according to the present invention, in order to fulfill the above object, the diffuser vane is formed so that the vane inlet diameter at the side plate end of the diffuser vane is larger than the vane inlet diameter at the core plate end.

Moreover, according to the present invention, in order to fulfill the above object, the vane at the side plate end of the diffuser vane is shaped so that it inclines in the direction, in which the impeller rotates, with respect to the vane at the core plate end.

The composition described above provides the following operation.

When the diffuser vane is formed so that the vane outlet angle at the side plate end of the single stage or a plurality of stages of the diffuser is larger than the vane outlet angle at the core plate end, the flow which attempts to flow toward the outer side of the bent passage is changed to a flow in the radial direction in the diffuser and the flow which attempts to flow toward the inner side is inclined toward the core plate end; therefore, the friction loss of the flow on the outer side in the bent passage can be reduced and the separation of the flow on the inner side can be prevented. This leads to higher efficiency.

When the diffuser vane is formed so that the vane outlet diameter at the side plate end of the single stage or a plurality of stages of the diffuser is larger than the vane outlet diameter at the core plate end, the larger diameter allows the outer flow at the bent portion to be guided to the downstream side; therefore, the line of flow at the bent passage is shortened and the flow which tends to move inward is inclined toward the core plate. Further, the diameter of the inscribed circle of the vane overlap outlet at the side plate end increases and the passage equivalent spreading angle becomes larger than that at the core plate end. Hence, the friction loss of the outer flow of the bent passage reduces and the inner flow can be prevented from being separated, permitting the efficiency in a large flow rate zone to be increased. The result is higher efficiency.

When the vane curve on the pressure surface end of a single stage or a plurality of stages is formed so that the side plate end and the core plate end share the same radius of curvature, while the vane curve on the negative pressure surface end is formed to have a radius of curvature so that the vane thickness at the core plate end is larger than that at the side plate end, the diameter of the inscribed circle of the vane overlap outlet at the side plate end increases and the passage equivalent spreading angle increases, causing the deceleration effect to be enhanced. In addition, the diameter of the inscribed circle of the vane overlap outlet at the core plate end decreases and the passage equivalent spreading angle decreases, causing the deceleration effect to be reduced. Furthermore, the diameter of the inscribed circle of the vane overlap outlet at the core plate end decreases and the passage equivalent spreading angle in the passage oblique direction decreases with consequent small deceleration effect. Accordingly, the efficiency increases in the large flow rate zone, and chances of stalling in the low flow rate zone are reduced. Thus, higher efficiency is accomplished.

When the diffuser vane is formed so that the vane inlet diameter at the side plate end of the diffuser vane is larger than the vane inlet diameter at the core plate end, the diameter of the inscribed circle of the vane overlap outlet at the side plate end increases and the passage equivalent spreading angle increases, and the passage equivalent spreading angle becomes larger than that at the core plate end, and the passage equivalent spreading angle in the passage oblique direction decreases with consequent small deceleration effect. Furthermore, chances of stalling in the low flow rate zone are reduced. Thus, higher efficiency is accomplished.

When the vane on the side plate end of the diffuser vane is shaped so that it inclines in the direction, in which the impeller rotates, with respect to the vane at the core plate end, the distance of the flow line in the oblique direction increases, the equivalent spreading angle is decreased, the deceleration effect is small, and the chances of stall in the low flow rate zone are reduced. Thus, higher efficiency can be achieved.

BEST MODE FOR CARRYING OUT THE INVENTION

The embodiments of the present invention will be described with reference to the accompanying drawings.

Figure 1:
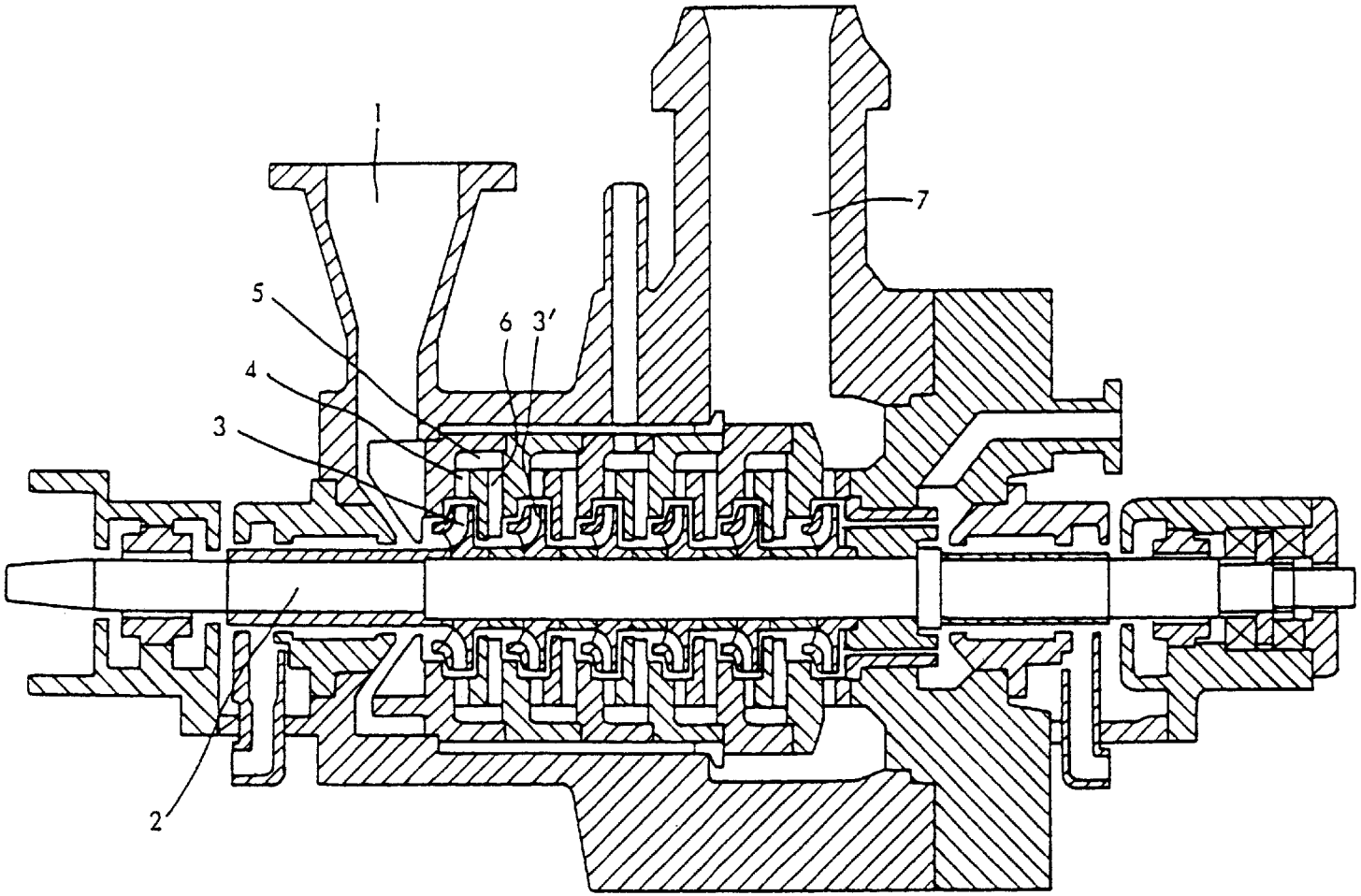
FIG. 1 is a longitudinal sectional view of a multi-stage boiler feed water pump according to a first embodiment of the present invention.
Figure 2:
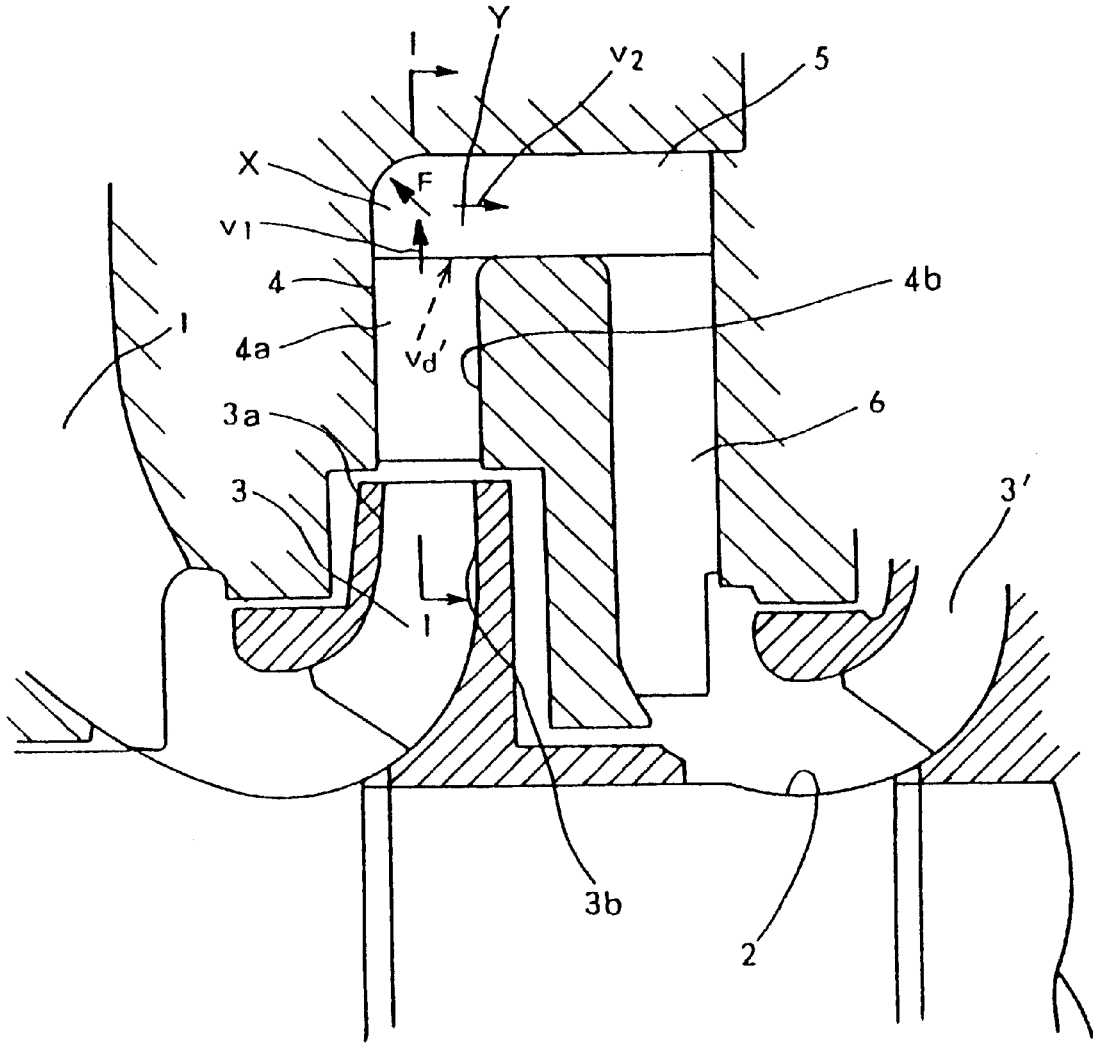
FIG. 2 is a longitudinal sectional view of an essential section of a first stage of FIG. 1.
Figure 3:
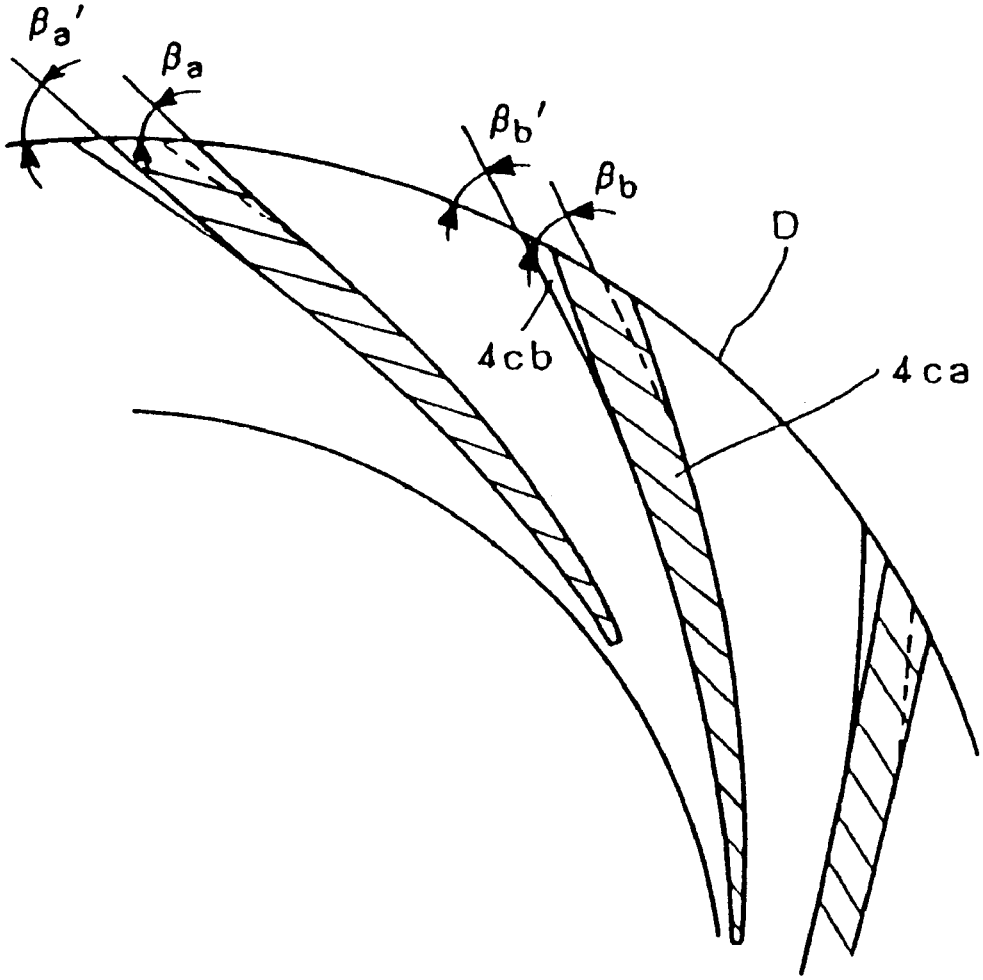
FIG. 3 is a sectional view of a diffuser taken along an arrow line I—I of FIG. 2.

FIG. 1 is a longitudinal sectional view of a multi-stage boiler feed water pump according to an embodiment of the present invention; FIG. 2 is a longitudinal sectional view of an essential section of a first stage of FIG. 1; and FIG. 3 is a sectional view taken along the line I—I of FIG. 2. In FIG. 1, reference numeral 1 denotes an inlet, reference numeral 2 denotes a main shaft, reference numeral 3 denotes a radial impeller (hereinafter referred to simply as "impeller") attached to the main shaft 2, and reference numeral 4 denotes a diffuser vane provided on a diffuser D located on the outer periphery of the impeller 3. The diffuser vane 4 has a function which guides a fluid, the pressure of which is increased by the impeller 3 before it flows out, so that the fluid moves outward (in the direction in which the radius increases from the center of the main shaft 2) while decelerating the fluid at the same time so as to recover static pressure. Reference numeral 5 denotes a bent passage for guiding the outward flow of the fluid into an inward flow, and reference numeral 6 denotes a return passage for gathering inward the flow of the fluid which has passed through the bent passage 5 and for leading it to the inlet of an impeller 3' of the next stage. Reference numeral 7 indicates an outlet for discharging the fluid, the pressure of which has been risen, out of the pump.

The multi-stage boiler feed water pump shown in FIG. 1 is constituted by installing the impeller 3, the diffuser vane 4, the bent passage 5, and the return passage 6 shown in FIG. 2 in multiple stages in the direction of the main shaft 2, thus providing the components from the pump inlet 1 to the outlet 7 in multiple stages.

The boiler feed water pump of the embodiment described above is characterized by the shape of the diffuser vane 4 provided on the diffuser D, the details of the shape being illustrated in FIG. 3. Vane outlet angle β on the pressure surface end (the projecting portion of the vane) of the diffuser vane 4 and vane outlet angle β' on the negative pressure surface end (the recessed portion of the vane) are set so that outlet angle βa at the side plate end is larger than outlet angle βb at the core plate end. In other words, the following relation applies.

$$\beta b<\beta a \quad (1)$$

$$\beta b'<\beta a' \quad (2)$$

The reason for setting as shown above will be described in FIG. 2.

When the bent passage 5 which has a sharp curve is disposed in the vicinity of the outlet of the diffuser D, a force is applied in a direction of arrow F to a radial upward flow v at the inlet of the bent passage 5 because of the change in the momentum which takes place when shifting it to the flow v in the direction of the main shaft. Therefore, the pressure at a point X closer to a side plate end 4*a* of the diffuser D becomes higher than the pressure at a point Y closer to a core plate end 4*b*. Hence, the flow in the vicinity of the outlet of the diffuser D becomes a flow which inclines from the radial direction toward the core plate end 4*b*. As a result, a boundary layer markedly develops along the side plate end 4*a*. On the other hand, a main flow approaches to the core plate end 4*b*, so that the development of the boundary layer becomes smaller. This trend is so noticeable that the handling flow rate is decreased from a design point, and the flow along the side plate end 4*a* separates, causing an unstable characteristic (a drop in the head-discharge curve) of the pump in the low flow rate zone.

Further, in the flow at the downstream side of the diffuser, the friction loss due to the contact with the wall surface cannot be ignored in the flow along the outer wall surface of the bent passage 5. The loss is proportional to the distance in which the flow moves while in contact with the wall surface; therefore, in order to reduce the loss, the distance of the line of flow for the flow along the outer wall surface of the bent passage 5 to reach the downstream return passage 6 is to be shortened.

Furthermore, the flow along the inner wall surface of the bent passage 5 tends to separate from the wall surface at a bent portion of a small radius of curvature, and the boundary layer develops on the downstream inner wall surface, disturbing the flow with a resultant loss; therefore, the separation at the bent portion should be restrained.

Figure 4:
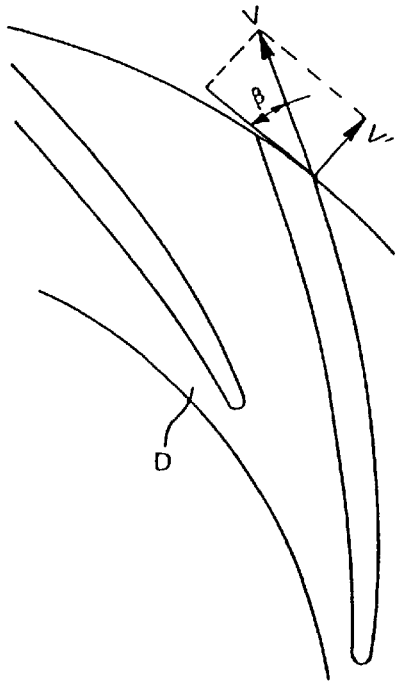
FIG. 4 is a schematic view of the velocity components of a flow in the diffuser.
Figure 5:
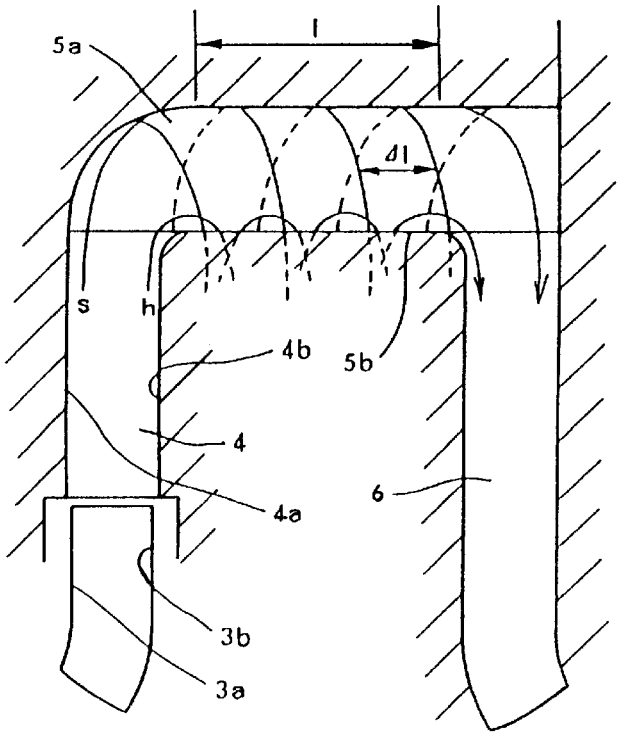
FIG. 5 is a schematic view of the flow of a fluid in the diffuser.

The flow of the fluid which has come out through the vane outlet of the diffuser D is in a free vortex flow state in the bent passage until it reaches the vane inlet of the downstream return passage 6. This will be described with reference to the schematic diagrams, FIG. 4 and FIG. 5; a flow V which has come out at an outflow angle β from the diffuser D changes its flowing direction from the radial direction to the main shaft direction at the bent portion and moves down while turning in the bent passage for a distance 1. The distance of the line of flow along the outer wall surface of the bent passage (line of flow s) increases as an axial moving distance Δl per unit turn decreases, whereas the distance of the line of flow decreases as the distance Δl increases. The distance Δl is proportional to the size of a radial component V' of the flow V; therefore, as the outlet angle β of the diffuser vane increases, the distance Δl accordingly increases, while as the outlet angle β of the diffuser vane decreases, the distance Δl accordingly decreases (the size of the outlet angle β of the diffuser vane and the distance of line of flow s in the bent passage share a proportional relationship).

The flow along the inner wall surface of the bent passage (line of flow h) easily separates from the wall surface when it passes through the bent portion of the small radius of curvature because of the centrifugal-field-effect if the radial component V' of the flow V is large. Hence, in order to prevent the flow from separating at the bent portion, the radial component of the flow V of the line of flow h should be reduced, that is, the outlet angle β of the diffuser vane should be reduced.

Further, distributing the vane outlet angle of the diffuser D and setting the distance of the line of flow s equal to that of h in the bent passage make it possible to reduce the collision loss or mixed loss of the flow coming into the vane inlet of the downstream return passage.

Figure 6:
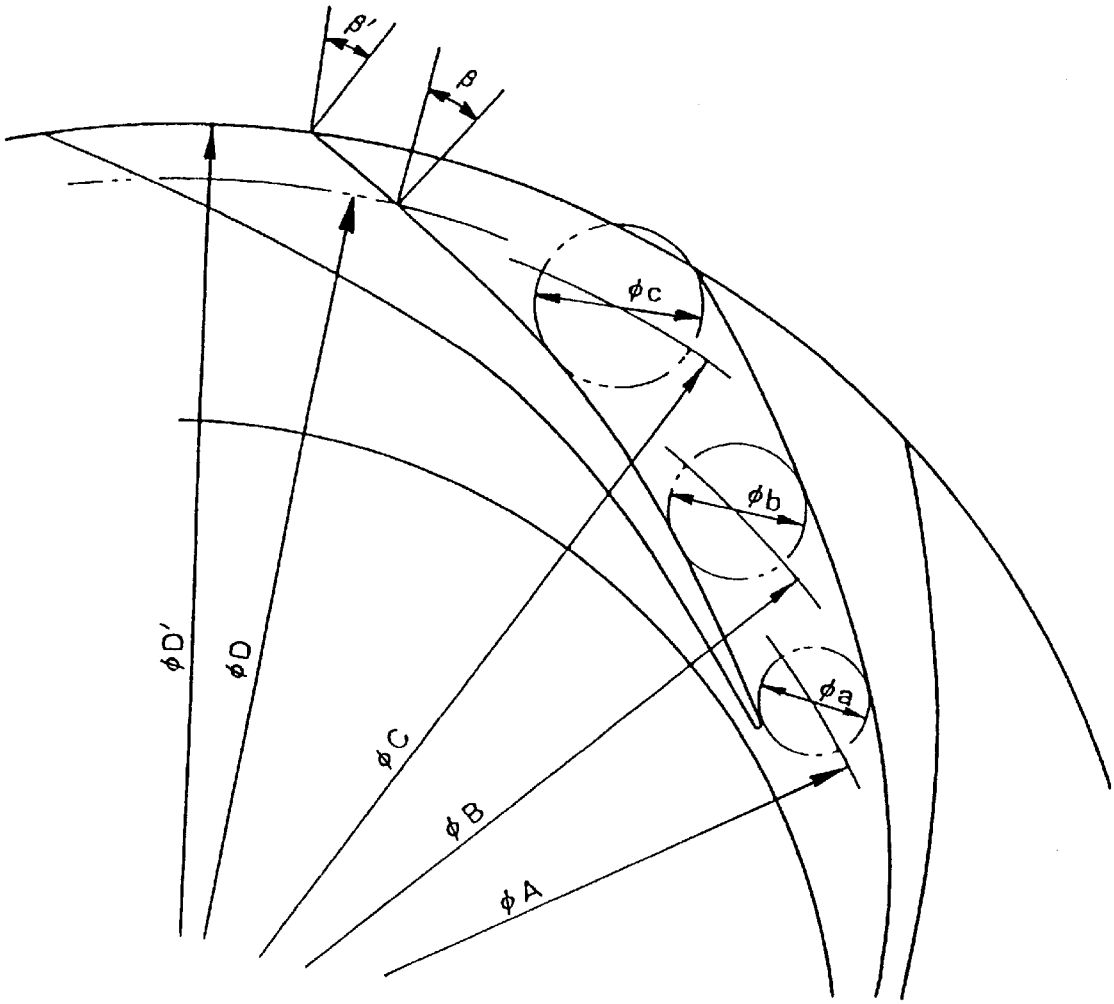
FIG. 6 is a diagram showing the relationship between the outlet diameter, the vane angle, and the inscribed circle diameter of the diffuser.

In general, the diffuser D functions to rise the pressure of the flow of the fluid, which has come out of the impeller 3 and which has a small outflow angle, while increasing the flow angle between vanes; therefore, as shown in FIG. 6, the vane angle increases as the outlet diameter of the diffuser vane increases and the inscribed circle diameter between adjacent vanes also increases. In other words, the following relationship applies:

$$\phi D < \phi D' \Rightarrow \beta < \beta' \quad (3)$$

$$\phi A < \phi B < \phi C \Rightarrow \phi a < \phi b < \phi c \quad (4)$$

Figure 7:
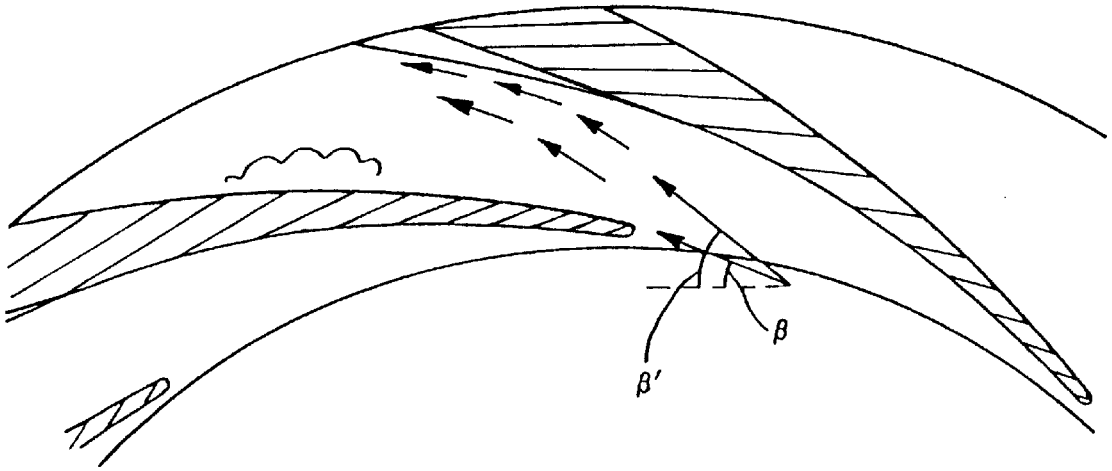
FIG. 7 is a schematic view of the flow of the fluid in a large flow zone in the diffuser.

When the flow of the fluid from the impeller 3 comes into the diffuser, the flow develops the inflow angle β' which is larger than the vane inlet angle β in the large flow rate zone as shown in FIG. 7; therefore, the flow moves along the vane negative pressure surface in the diffuser. Hence, separation takes place in the downstream area at the vane pressure surface end; however, it is restrained by the bounce of the flow from the negative pressure surface end, so that the boundary layer does not develop much. In the downstream zone, however, the passage becomes narrower due to the separation at the pressure surface end and the deceleration effect decreases; therefore, in order to enhance the deceleration effect, the vane should be formed to have the hatched shape to increase the width of the passage in the vicinity of the passage outlet at the vane overlapping portion.

Figure 8:
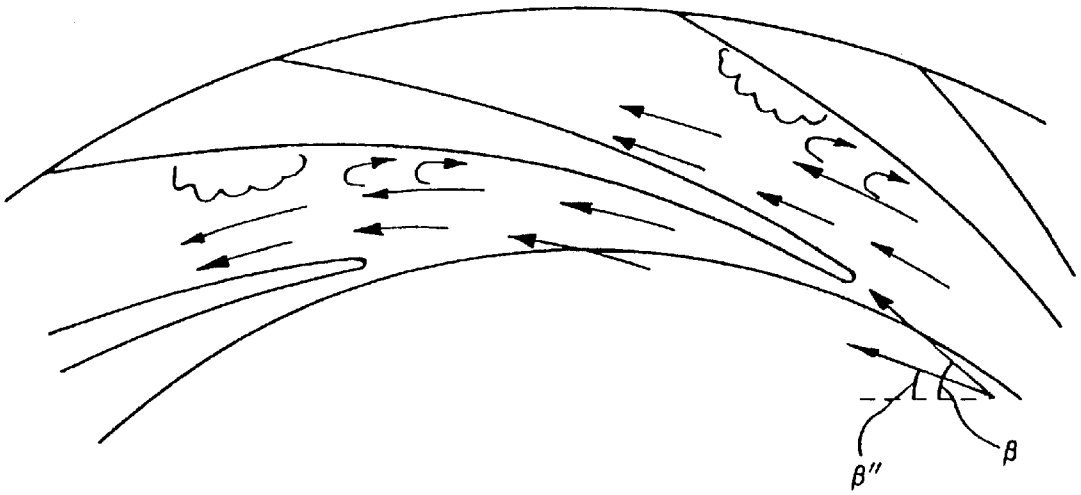
FIG. 8 is a schematic view of the flow of the fluid in a small flow zone in the diffuser.

In the low flow rate zone, the flow has an inflow angle β" which is smaller than the vane inlet angle β as shown in FIG. 8; therefore, the flow comes to move along the vane pressure surface in the diffuser. Hence, the separation takes place in the downstream zone at the vane negative pressure surface end, and a part of the flow moves back rather than moving downstream. This tendency increases as the spreading angle of the passage at the vane overlapping portion increases. For this reason, the spreading angle of the passage should be made small in the low flow rate zone.

As described above, the diffuser vane should be shaped such that the passage spreading angle at the vane overlapping portion is large in the large flow zone, while the passage spreading angle is small in the low flow rate zone.

Figure 9:
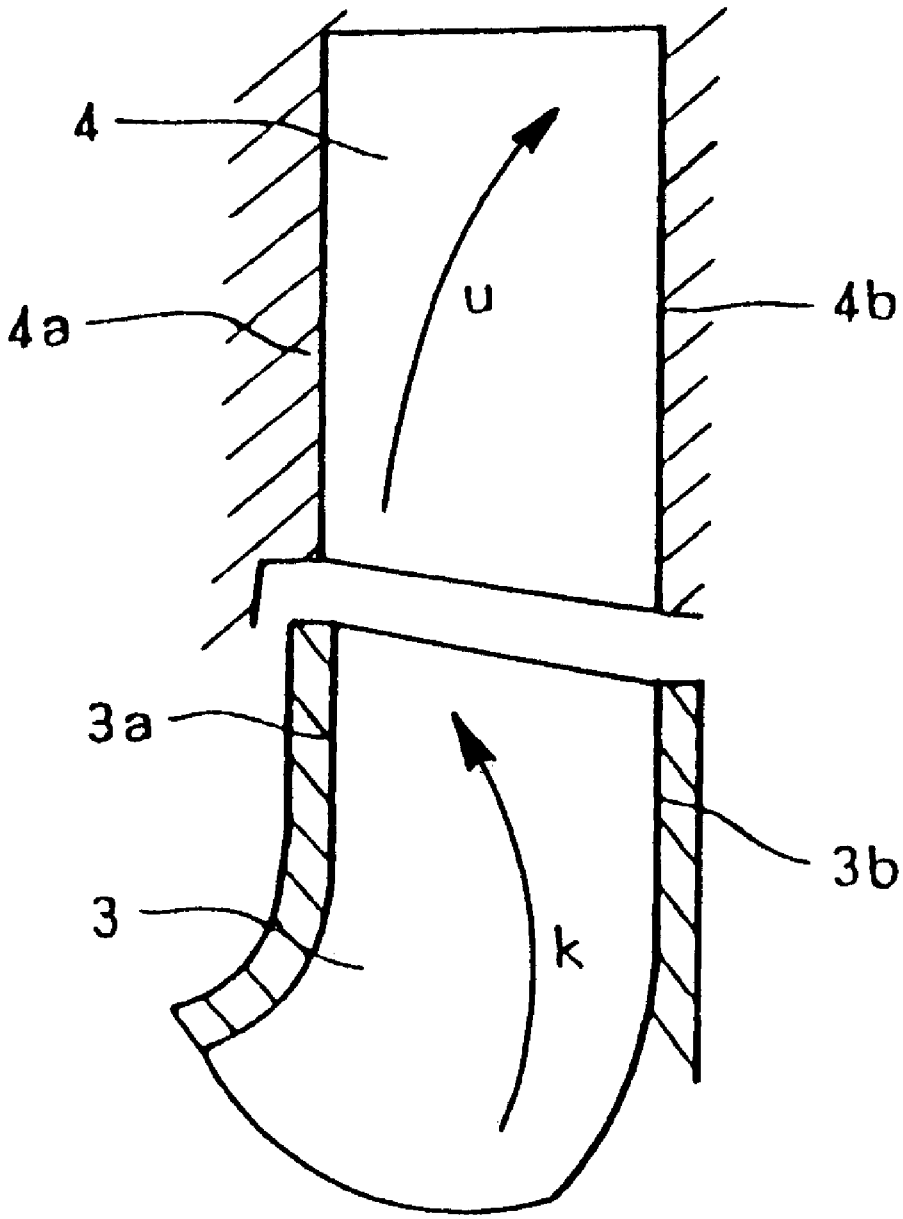
FIG. 9 is a schematic view of the flow of the fluid in the combination of an impeller with a skew and a diffuser in which a diffuser vane has been formed.

As illustrated in FIG. 9, when an impeller in which the vane outside diameter is larger at the side plate end than that at the core plate end is used, the flow moves in the full width of the passage in the flow rate range other than the low flow rate zone, the line of flow in the low flow rate zone being deflected toward the side plate end where the vane outside diameter is larger, as indicated by the line of flow k. When the flow comes into the diffuser, the flow is deflected as indicated by the line of flow u. If a large passage spreading angle at the vane overlapping portion in the direction of the line of flow in the low flow rate zone is set, then the flow easily moves back. Therefore, increasing the vane inlet diameter at the side plate end of the diffuser D increases the diameter of the inlet inscribed circle, so that the passage spreading angle in the flowing direction of the line of flow u decreases, reducing the chances of the backflow.

Distributing the vane outlet angle of the diffuser vane between the side plate end and the core plate end of the diffuser and setting the distance of the line of flow on the outer wall surface equal to that of the inner wall surface in the bent passage make it possible to reduce the collision loss or mixed loss of the flow at the vane inlet of the return passage.

As described above, according to the present invention, the flowing distance of the fluid which comes out from the side plate end of the diffuser and flows on the outer side in the bent passage is shortened, thus reducing the loss from the friction with the wall surface.

Figure 10:
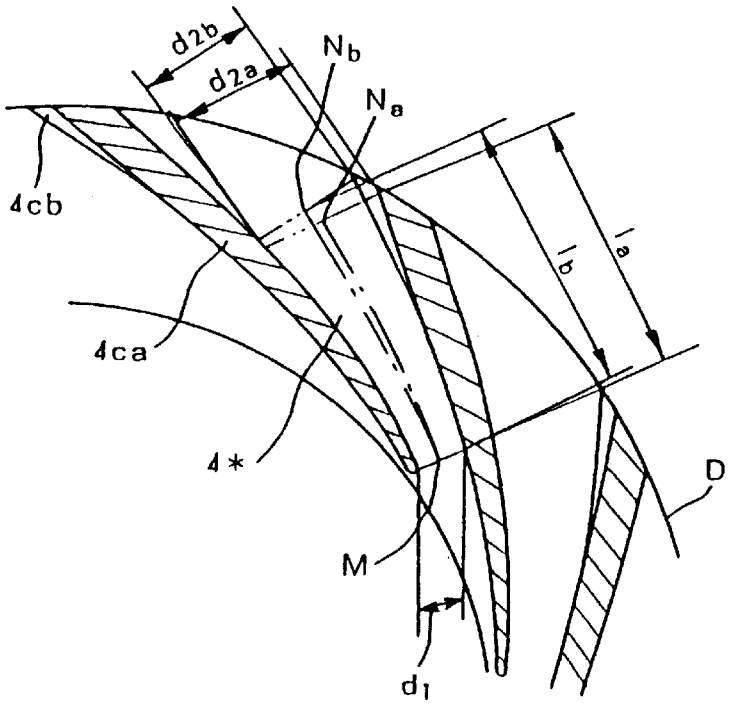
FIG. 10 is a sectional view of a diffuser according to another embodiment of the present invention.
Figure 11:
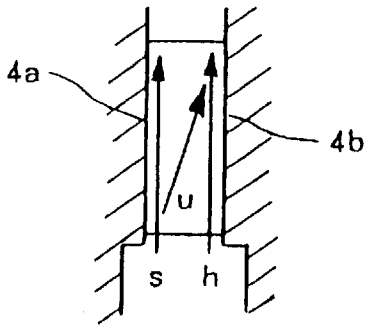
FIG. 11 is a schematic view of the flow of the fluid in the embodiment illustrated in FIG. 10.

Another embodiment of the present invention is shown in FIG. 10 and FIG. 11.

FIG. 10 is a sectional view of a diffuser; and FIG. 11 is a schematic view of the flow of the fluid. As illustrated, the vane is shaped so that the inter-vane spread increases at a vane portion 4*ca* at the side plate end (indicated by the hatched area) and the inter-vane spread decreases at a vane portion 4*cb* at the core plate end in a spreading inter-vane passage section 4* constituted by overlapping adjacent vanes of the diffuser D.

A passage width $d_1$ at an inlet point M in the spreading inter-vane passage 4* at the vane portions 4*ca* and 4*cb* is the same but it comes to differ toward the outlet. More specifically, the outlet point on the vane 4*ca* end is denoted as Na and the passage width is denoted by $d_2a$, whereas the outlet point on the vane portion 4*cb* end is denoted by Nb, the passage width being $d_2b$. Thus, the passage lengths are indicated by 1*a* and 1*b*, respectively, and the inter-vane passage spreading angles θ*a* and θ*b* will be respectively expressed as follows:

$$\theta a \approx 2\tan^{-1}\frac{d_2a - d_1}{21a} \tag{5}$$

$$\theta b \approx 2\tan^{-1}\frac{d_2a - d_1}{21a} \tag{6}$$

As is obvious from the drawing, $d_2a > d_2b$, 1*a*<1*b*; therefore, θ*a* (side plate end)>θ*b* (core plate end).

Accordingly, in the large flow rate zone, since the inter-vane spreading angle on the line of stream s on the side plate end 4*a* of the diffuser D is large, the deceleration effect of the flow is improved with resultant higher efficiency; in the low flow rate zone, the lines of the main flow become u and h, so that every inter-vane spreading angle becomes smaller than the spreading angle formed in the case of the line of flow s, thus reducing the chances of the backflow of the fluid.

Figure 12:
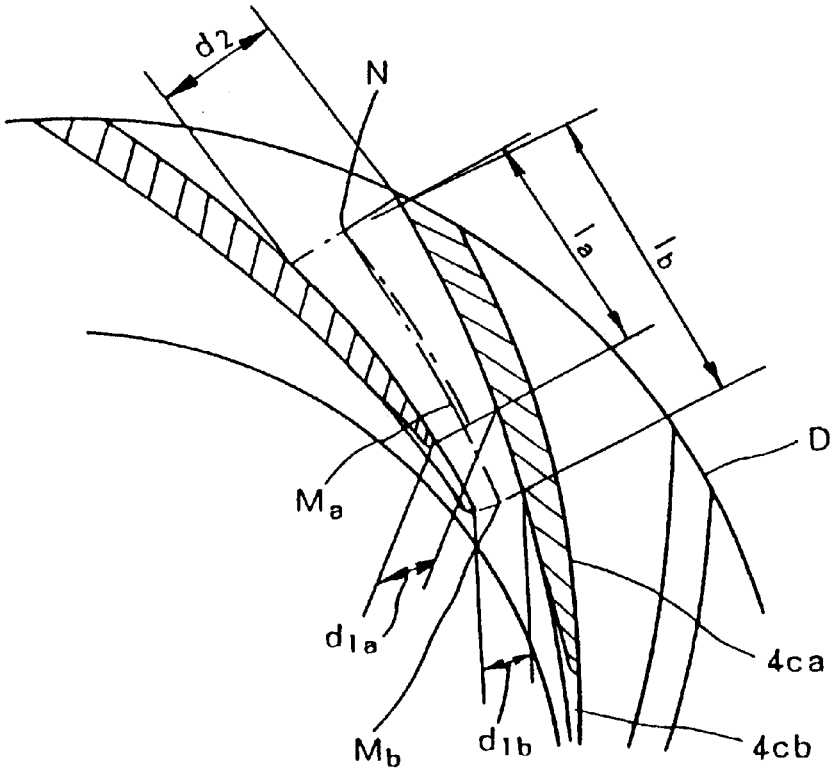
FIG. 12 is a sectional view of a diffuser according to still another embodiment of the present invention.
Figure 13:
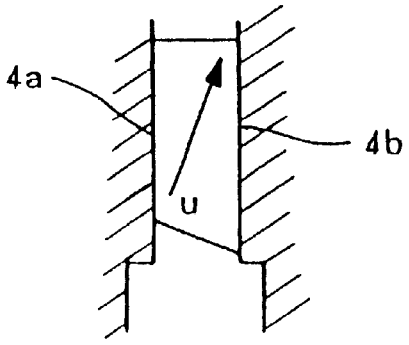
FIG. 13 is a schematic view of the flow of the fluid in the embodiment illustrated in FIG. 12.

A further embodiment of the present invention is shown in FIG. 12 and FIG. 13.

FIG. 12 is a sectional view of a diffuser; and FIG. 13 is a schematic representation of the flow of the fluid. When the diffuser D is shaped such that the vane inlet diameter at the side plate end 4*ca* (as indicated by hatching) is larger than that at the core plate end 4*cb*, the inlet inscribed circle diameter in the direction of the line of flow u is indicated by $d_1a$ which is larger than $d_1b$; as a result, the inter-vane spreading angle decreases and the same advantage as that obtained by the shape shown in FIG. 6 can be accomplished, and furthermore, this embodiment is advantageous in reducing the size because the outside diameter can be left unchanged.

Figure 14:
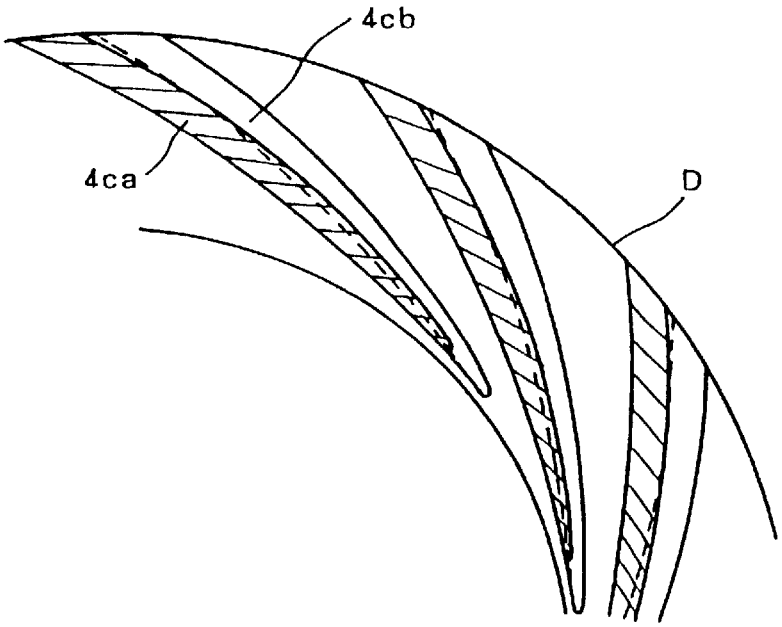
FIG. 14 is a sectional view of a diffuser according to yet another embodiment of the present invention.
Figure 15:
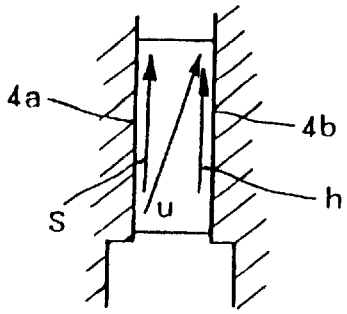
FIG. 15 is a schematic view of the flow of the fluid in the embodiment illustrated in FIG. 14.

Yet another embodiment of the present invention is shown in FIG. 14 and FIG. 15.

FIG. 14 is a sectional view of a diffuser; and FIG. 15 is a schematic representation of the flow of the fluid. When the diffuser vanes are shaped such that the vanes (hatched ones) at the side plate end 4*a* are relatively inclined in the direction in which the impeller 3 rotates (shifted in the circumferential direction) with respect to the core plate end 4*b*, the distance of the line of flow from the vane inlet to outlet in the direction of the line of flow u which is the main flow in the low flow rate zone is increased; as a result, the inter-vane spreading angle decreases and the same advantage as that obtained by the shape shown in FIG. 6 can be accomplished, and furthermore, this embodiment is advantageous in reducing the size because the outside diameter can be left unchanged.

Figure 16:
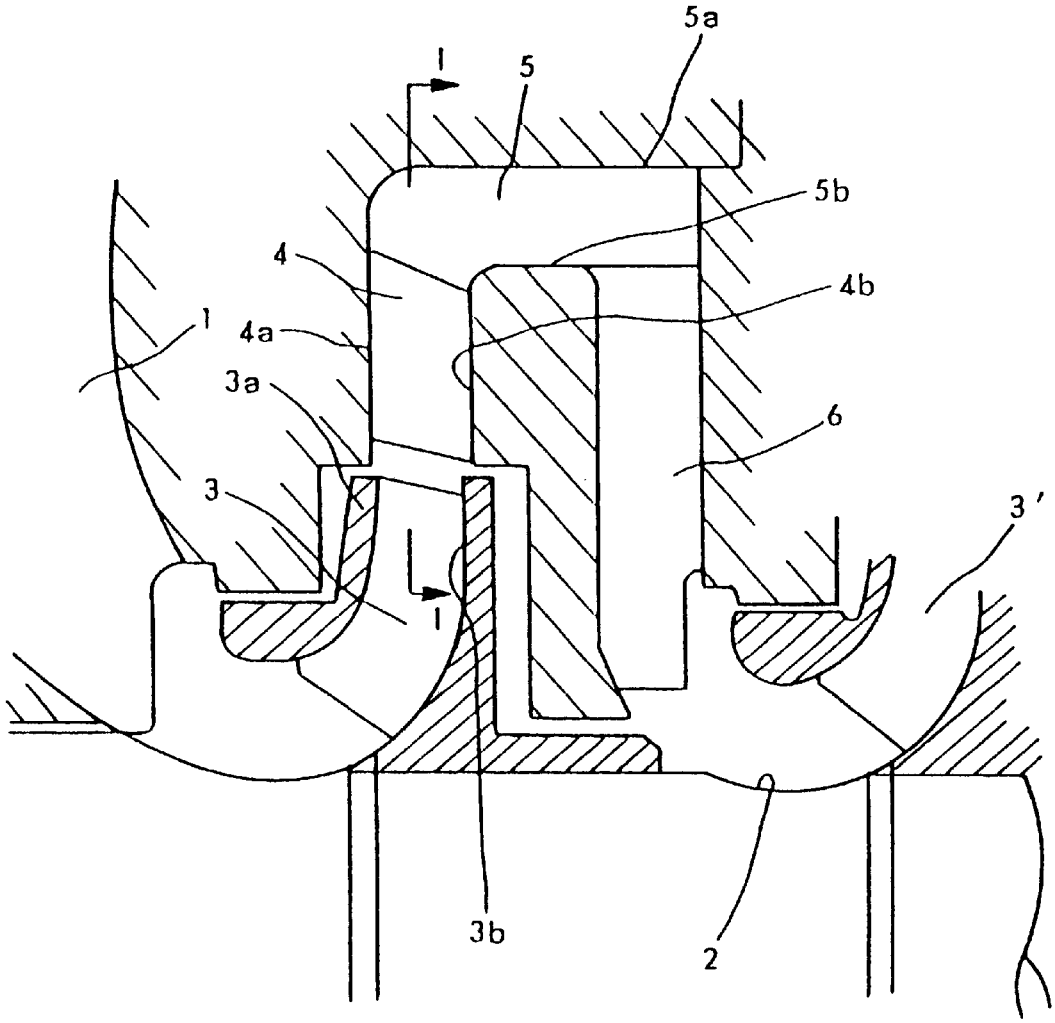
FIG. 16 is a sectional view of an essential constituent section of a further embodiment of the present invention.

A further embodiment of the present invention is illustrated in FIG. 16.

The drawing is a sectional view of an essential section; the embodiment has a radial impeller 3 (hereinafter referred to simply as an "impeller with a skew") in which the vane outlet diameter at the side plate end 4*a* is larger than that at the core plate end 4*b* attached to the main shaft 2. In the case of the low flow rate zone, as shown in FIG. 9, the line of flow k of the main flow in the impeller is deflected toward the side plate end 3*a*, and it is deflected toward the core plate end 4 as indicated by the line of flow u in the diffuser D; therefore, making the vane inlet diameter at the side plate end 4*a* of the diffuser D larger than that at the core plate end 4*b* decreases the inter-vane passage spreading angle in the direction of the line of flow u, thus reducing the chances of backflow.

Figure 17:
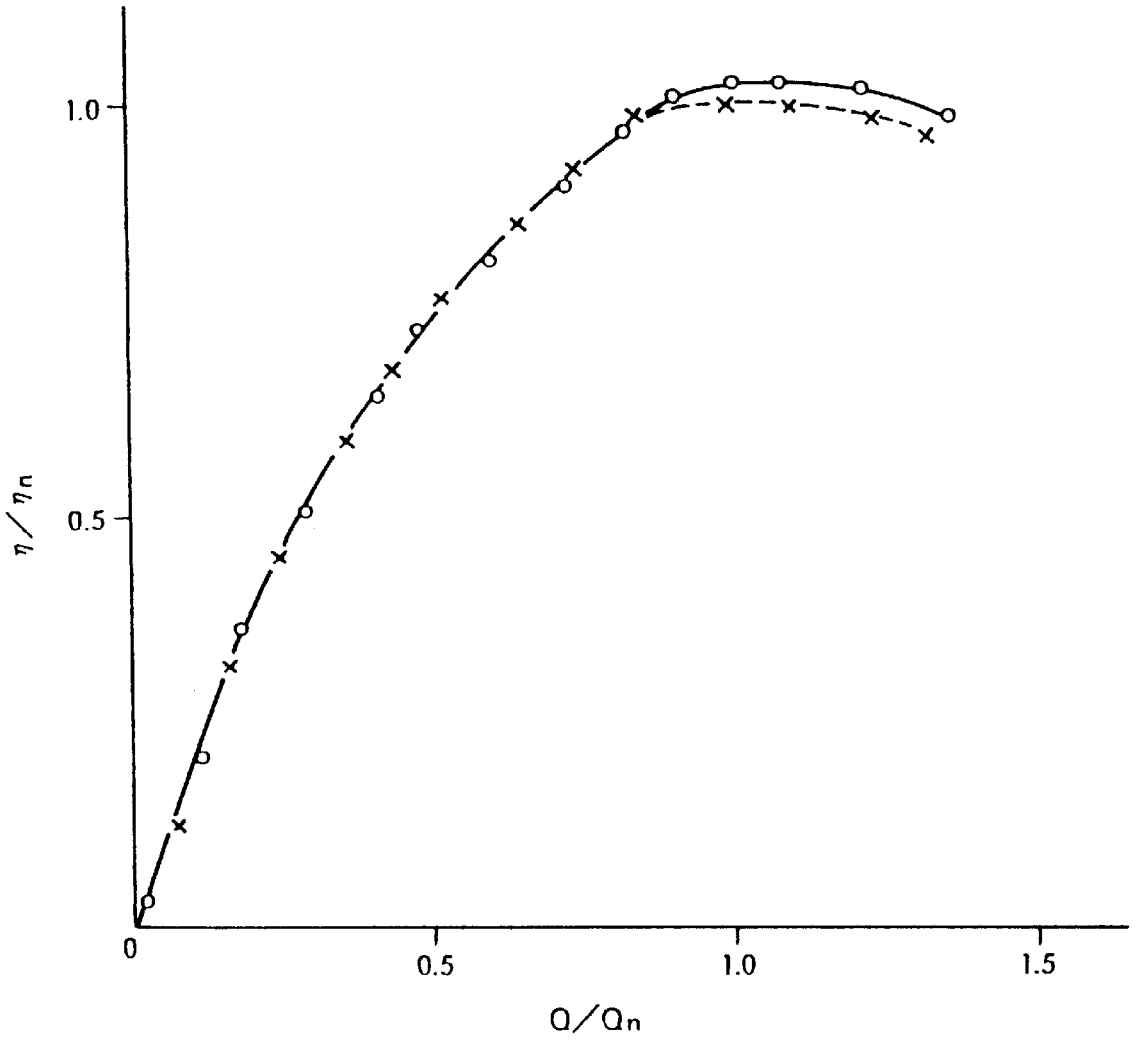
FIG. 17 is a curve diagram illustrating the comparison in characteristics between the embodiment shown in FIG. 16 and a conventional embodiment.

FIG. 17 is a characteristic curve diagram illustrating the results of the research into performance and efficiency of the diffuser D of the embodiment shown in FIG. 16 and of the conventional diffuser. The axis of abscissa indicates experimental flow rate which has been converted to dimensionless values by a design flow rate Qn and which is indicated by (Q/Qn); the axis of ordinate indicates each efficiency which has been converted to dimensionless values by efficiency ηn at the design flow rate of the conventional diffuser and which is indicated by (η/ηn). As it is obvious from the diagram, the efficiency of the diffuser D (circled in the chart) of the embodiment is higher than that of the conventional diffuser (cross-marked in the chart) in the large flow zone.

Figure 18:
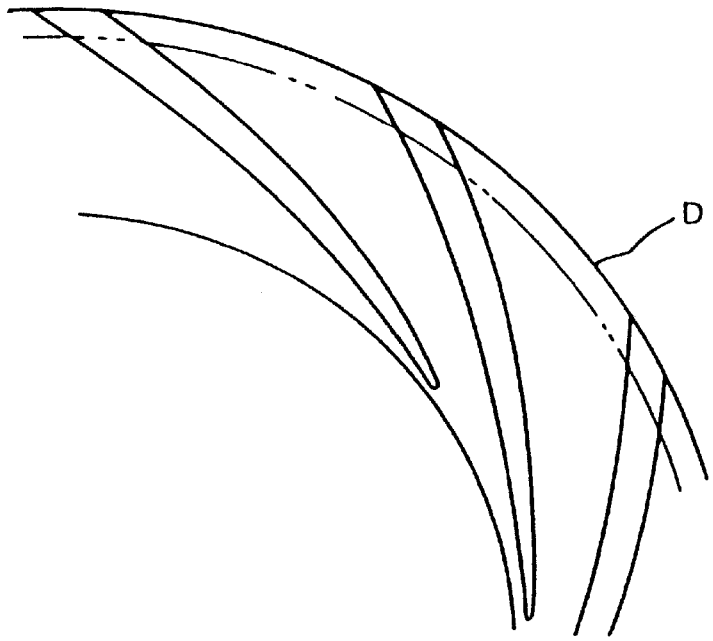
FIG. 18 is a sectional view of a diffuser according to another embodiment of the present invention.
Figure 19:
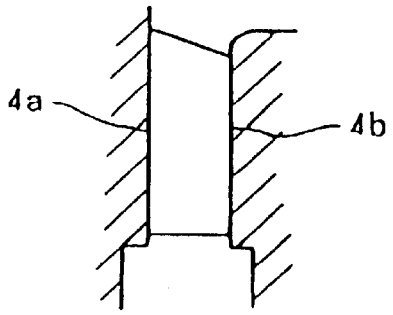
FIG. 19 is a cross-sectional view of the diffuser according to the embodiment shown in FIG. 18.

A further embodiment of the present invention is shown in FIG. 18 and FIG. 19.

FIG. 18 is a sectional view of a diffuser; and FIG. 19 is a lateral profile of the diffuser. The vane outlet diameter at the side plate end 4 of the diffuser D is made larger than that at the core plate end 4*b*, and the vane outlet angle is distributed in the direction of the vane width of the diffuser D, providing the same advantage as in the embodiment illustrated in FIG. 3; moreover, as the larger vane outlet diameter provides a larger vane angle and a larger inter-vane inscribed circle, thus increasing the equivalent spreading angle. Hence, the embodiment is advantageous in that the pressure restoring performance which is the basic purpose of the diffuser D can be improved.

According to the present invention, when a centrifugal type fluid machine has multiple stages, the loss in a bent passage on the downstream side of a diffuser can be reduced by making the vane outlet angle or the vane outlet diameter at the side plate end of the diffuser larger than the vane outlet angle or the vane outlet diameter at the core plate end.

Further, when the centrifugal type fluid machine has multiple stages or a single stage, the separation of flow taking place in a low flow rate zone can be prevented without sacrificing the efficiency in a large flow rate zone by making the spread of the diffuser passage at the side plate end larger than the spread of the diffuser passage at the core plate end in a spreading inter-vane passage constructed by overlapping adjacent diffuser vanes, thus permitting higher efficiency and stable characteristics.

Moreover, in the case of a multi-stage type or a single-stage type, the equivalent spreading angle of the spreading inter-vane passage can be decreased in the direction of the line of the main flow in which the flow deflected toward the impeller side plate end in the low flow rate zone is deflected toward the impeller core plate end in the diffuser and the separation of flow taking place in the low flow rate zone can be prevented without sacrificing the efficiency in the large flow rate zone by making the vane inlet diameter of the diffuser at the side plate end larger than that at the core plate end in the diffuser combined with a radial impeller in which the vane outlet diameter at the side plate end is larger than the vane outlet diameter at the core plate end, thus permitting higher efficiency and stable characteristics.

We claim:

1. A centrifugal type fluid machine comprising: a radial impeller which is attached to a main shaft and which rotates together with said main shaft, a diffuser which is located on an outer periphery of said radial impeller and guides a flow of a fluid coming out of said radial impeller so that it is directed outward to recover static pressure, a diffuser vane formed on said diffuser, and a stage which forms a bent passage for guiding an outward flow coming out of said diffuser to an inward flow and a return passage for gathering inward the flow coming out of said bent passage and for guiding it to an inlet of a radial impeller of the next stage, which are mounted in multiple stages in the axial direction; characterized in that said diffuser vane is formed so that a vane outlet angle at a side plate end of a plurality of stages of said diffuser is larger than a vane outlet angle at a core plate end.

2. A centrifugal type fluid machine comprising: a radial impeller which is attached to a main shaft and which rotates together with said main shaft, a diffuser which is located on an outer periphery of said radial impeller and guides a flow of a fluid coming out of said radial impeller so that it is directed outward to recover static pressure, a diffuser vane formed on said diffuser, and a stage which forms a bent passage for guiding an outward flow coming out of said diffuser to an inward flow and a return passage for gathering inward the flow coming out of said bent passage and for guiding it to an inlet of a radial impeller of the next stage, which are mounted in multiple stages in the axial direction; characterized in that said diffuser vane is formed so that a vane outlet diameter at a side plate end of a single stage or a plurality of stages of said diffuser is larger than a vane outlet diameter at a core plate end.

3. A centrifugal type fluid machine comprising: a radial impeller which is attached to a main shaft and which rotates together with said main shaft, a diffuser which is located on an outer periphery of said radial impeller and guides a flow of a fluid coming out of said radial impeller so that it is directed outward to recover static pressure, a diffuser vane formed on said diffuser, and a stage which forms a bent passage for guiding an outward flow coming out of said diffuser to an inward flow and a return passage for gathering inward the flow coming out of said bent passage and for guiding it to an inlet of a radial impeller of the next stage, which are mounted in multiple stages in the axial direction; characterized in that a vane curve at a pressure surface end of a plurality of stages of said diffuser is formed so that it has the same radius of curvature at a side plate end and at a core plate end, while the vane curve at a negative pressure surface end is formed to have a radius of curvature so that the vane thickness at the core plate end is larger than that at the side plate end.

4. A centrifugal type fluid machine comprising: a radial impeller which is attached to a main shaft and which rotates together with said main shaft, a diffuser which is located on an outer periphery of said radial impeller and guides a flow of a fluid coming out of said radial impeller so that it is directed outward to recover static pressure, a diffuser vane formed on said diffuser, and a stage which forms a bent passage for guiding an outward flow coming out of said diffuser to an inward flow and a return passage for gathering inward the flow coming out of said bent passage and for guiding it to an inlet of a radial impeller of the next stage, which are mounted in multiple stages in the axial direction; characterized in that said diffuser vane is formed so that a vane inlet diameter at a side plate end of said diffuser vane is larger than a vane inlet diameter at a core plate end, and said vane is formed so that a vane outlet diameter at the side plate end of said radial impeller is larger than a vane outlet diameter at the core plate end.

5. A centrifugal type fluid machine comprising: a radial impeller which is attached to a main shaft and which rotates together with said main shaft, a diffuser which is located on an outer periphery of said radial impeller and guides a flow of a fluid coming out of said radial impeller so that it is directed outward to recover static pressure, a diffuser vane formed on said diffuser, and a stage which forms a bent passage for guiding an outward flow coming out of said diffuser to an inward flow and a return passage for gathering inward the flow coming out of said bent passage and for guiding it to an inlet of a radial impeller of the next stage, which are mounted in multiple stages in the axial direction; characterized in that said diffuser vane is formed so that a vane outlet angle at a side plate end of a single stage or a plurality of stages of said diffuser is larger than a vane outlet angle at a core plate end, and said diffuser vane is formed so that a vane outlet diameter at the side plate end of the single stage or the plurality of stages of said diffuser is larger than a vane outlet diameter at the core plate end.

6. A centrifugal type fluid machine comprising: a radial impeller which is attached to a main shaft and which rotates together with said main shaft, a diffuser which is located on an outer periphery of said radial impeller and guides a flow of a fluid coming out of said radial impeller so that it is directed outward to recover static pressure, and a diffuser vane formed on said diffuser; characterized in that said diffuser vane is formed so that a vane outlet angle at a side plate end of a single stage or a plurality of stages of said diffuser is larger than a vane outlet angle at a core plate end, and said diffuser vane is formed so that a vane inlet diameter at the side plate end of said diffuser vane is larger than a vane inlet diameter at the core plate end.

7. A centrifugal type fluid machine according to claim 6, characterized in that said vane is formed so that a vane outlet diameter at the side plate end of said radial impeller is larger than a vane outlet diameter at the core plate end.

8. A centrifugal type fluid machine comprising: a radial impeller which is attached to a main shaft and which rotates together with said main shaft, a diffuser which is located on an outer periphery of said radial impeller and guides a flow of a fluid coming out of said radial impeller so that it is directed outward to recover static pressure, and a diffuser vane formed on said diffuser; characterized in that said diffuser vane is formed so that a vane outlet angle at a side plate end of a plurality of stages of said diffuser is larger than a vane outlet angle at a core plate end, and a vane at the side plate end of said diffuser vane is shaped so that it is inclined in a direction, in which said impeller rotates, with respect to a vane at the core plate end.

9. A centrifugal type fluid machine comprising: a radial impeller which is attached to a main shaft and which rotates together with said main shaft, a diffuser which is located on an outer periphery of said radial impeller and guides a flow of a fluid coming out of said radial impeller so that it is directed outward to recover static pressure, and a diffuser vane formed on said diffuser; wherein said diffuser vane is formed so that a vane outlet diameter at a side plate end of a single stage or a plurality of stages of said diffuser is larger than a vane outlet diameter at a core plate end, and the vane curve at the pressure surface end of the single stage or a plurality of stages of said diffuser is formed so that it has the same radius of curvature at the side plate end and at the core plate end, while the vane curve at a negative pressure surface end is formed to have a radius of curvature so that the vane thickness at the core plate end is larger than that at the side plate end.

10. A centrifugal type fluid machine comprising: a radial impeller which is attached to a main shaft and which rotates together with said main shaft, a diffuser which is located on an outer periphery of said radial impeller and guides a flow of a fluid coming out of said radial impeller so that it is directed outward to recover static pressure, and a diffuser vane formed on said diffuser; characterized in that said diffuser vane is formed so that a vane outlet diameter at a side plate end of a single stage or a plurality of stages of said diffuser is larger than a vane outlet diameter at a core plate end, and said diffuser vane is formed so that a vane inlet diameter at the side plate end of the single stage or the plurality of stages of said diffuser is larger than a vane inlet diameter at the core plate end.

11. A centrifugal type fluid machine according to claim 10, wherein said vane is formed so that a vane outlet diameter at the side plate end of said radial impeller is larger than a vane outlet diameter at the core plate end.

12. A centrifugal type fluid machine comprising: a radial impeller which is attached to a main shaft and which rotates together with said main shaft, a diffuser which is located on an outer periphery of said radial impeller and guides a flow of a fluid coming out of said radial impeller so that it is directed outward to recover static pressure, and a diffuser vane formed on said diffuser; characterized in that said diffuser vane is formed so that a vane outlet diameter at a side plate end of a single stage or a plurality of stages of said diffuser is larger than a vane outlet diameter at a core plate end, and a vane at the side plate end of said diffuser vane is shaped so that it is inclined in a direction, in which said impeller rotates, with respect to a vane at the core plate end.

13. A centrifugal type fluid machine comprising: a radial impeller which is attached to a main shaft and which rotates together with said main shaft, a diffuser which is located on an outer periphery of said radial impeller and guides a flow of a fluid coming out of said radial impeller so that it is directed outward to recover static pressure, and a diffuser vane formed on said diffuser; characterized in that a vane curve at a pressure surface end of a single stage or a plurality of stages of said diffuser is formed so that it has the same radius of curvature at the side plate end and at the core plate end, while the vane curve at a negative pressure surface end is formed to have a radius of curvature so that the vane thickness at the core plate end is larger than that at the side plate end, and said diffuser vane is formed so that a vane inlet diameter at the side plate end of the single stage or the plurality of stages of said diffuser is larger than a vane inlet diameter at the core plate end.

14. A centrifugal type fluid machine according to claim 13, characterized in that said vane is formed so that a vane outlet diameter at the side plate end of said radial impeller is larger than a vane outlet diameter at the core plate end.

15. A centrifugal type fluid machine comprising: a radial impeller which is attached to a main shaft and which rotates together with said main shaft, a diffuser which is located on an outer periphery of said radial impeller and guides a flow of a fluid coming out of said radial impeller so that it is directed outward to recover static pressure, and a diffuser vane formed on said diffuser; characterized in that a vane curve at a pressure surface end of a plurality of stages of said diffuser is formed so that it has the same radius of curvature at the side plate end and at the core plate end, while the vane curve at a negative pressure surface end is formed to have a radius of curvature so that the vane thickness at the core plate end is larger than that at the side plate end, and a vane at the side plate end of said diffuser vane is shaped so that it is inclined in a direction, in which said impeller rotates, with respect to a vane at the core plate end.

16. A centrifugal type fluid machine comprising: a radial impeller which is attached to a main shaft and which rotates together with said main shaft, a diffuser which is located on an outer periphery of said radial impeller and guides a flow of a fluid coming out of said radial impeller so that it is directed outward to recover static pressure, and a diffuser vane formed on said diffuser, characterized in that said diffuser vane is formed so that a vane inlet diameter at a side plate end of a single stage or a plurality of stages of said diffuser is larger than a vane inlet diameter at a core plate end, and a vane at the side plate end of said diffuser vane is shaped so that it is inclined in a direction, in which said impeller rotates, with respect to a vane at the core plate end, and the vane is formed so that a vane outlet diameter at the side plate end of said radial impeller is larger than a vane outlet diameter at the core plate end.

17. A centrifugal type fluid machine comprising: a radial impeller which is attached to a main shaft and which rotates together with said main shaft, a diffuser which is located on an outer periphery of said radial impeller and guides a flow of a fluid coming out of said radial impeller so that it is directed outward to recover static pressure, a diffuser vane formed on said diffuser, and a stage which forms a bent passage for guiding an outward flow coming out of said diffuser to an inward flow and a return passage for gathering inward the flow coming out of said bent passage and for guiding it to an inlet of a radial impeller of the next stage, which are mounted in multiple stages in the axial direction; characterized in that said diffuser vane is formed so that a vane outlet angle at a side plate end of a single stage or a plurality of stages of said diffuser is larger than a vane outlet angle at a core plate end, and said diffuser is formed so that a vane inlet diameter at the side plate end of the single stage or the plurality of stages of said diffuser is larger than a vane inlet diameter at the core plate end.

18. A centrifugal type fluid machine comprising: a radial impeller which is attached to a main shaft and which rotates together with said main shaft, a diffuser which is located on an outer periphery of said radial impeller and guides a flow of a fluid coming out of said radial impeller so that it is directed outward to recover static pressure, a diffuser vane formed on said diffuser, and a stage which forms a bent passage for guiding an outward flow coming out of said diffuser to an inward flow and a return passage for gathering inward the flow coming out of said bent passage and for guiding it to an inlet of a radial impeller of the next stage, which are mounted in multiple stages in the axial direction; characterized in that said diffuser vane is formed so that a vane outlet angle at a side plate end of a single stage or a plurality of stages of said diffuser is larger than a vane outlet angle at a core plate end, said diffuser vane is formed so that a vane outlet diameter at the side plate end of the single stage or the plurality of stages of said diffuser is larger than a vane outlet diameter at the core plate end, and a vane at the side plate end of said diffuser vane is shaped so that it is inclined in a direction, in which said impeller rotates, with respect to a vane at the core plate end.

19. A centrifugal type fluid machine comprising: a radial impeller which is attached to a main shaft and which rotates together with said main shaft, a diffuser which is located on an outer periphery of said radial impeller and guides a flow of a fluid coming out of said radial impeller so that it is directed outward to recover static pressure, and a diffuser vane formed on said diffuser; characterized in that said diffuser vane is formed so that a vane outlet angle at a side plate end of a single stage or a plurality of stages of said diffuser is larger than a vane outlet angle at a core plate end, said diffuser vane is formed so that a vane inlet diameter at the side plate end of the single stage or the plurality of stages of said diffuser is larger than a vane inlet diameter at the core plate end, and a vane at the side plate end of said diffuser vane is shaped so that it is inclined in a direction, in which said impeller rotates, with respect to a vane at the core plate end.

20. A centrifugal type fluid machine comprising: a radial impeller which is attached to a main shaft and which is located on an outer periphery of said radial impeller and guides a flow of a fluid coming out of said radial impeller so that it is directed outward to recover static pressure, and a diffuser vane formed on said diffuser; characterized in that said diffuser vane is formed so that a vane outlet diameter at a side plate end of a single stage or a plurality of stages of said diffuser is larger than a vane outlet diameter at a core plate end, a vane curve at a pressure surface end of the single stage or the plurality of stages of said diffuser is formed so that it has the same radius of curvature at the side plate end and at the core plate end, while a vane curve at a negative pressure surface end is formed to have a radius of curvature so that the vane thickness at the core plate end is larger than that at the side plate end, and said diffuser vane is formed so that a vane inlet diameter at the side plate end of the single stage or the plurality of stages of said diffuser is larger than a vane inlet diameter of the core plate end.

21. A centrifugal type fluid machine comprising: a radial impeller which is attached to a main shaft and which rotates together with said main shaft, a diffuser which is located on an outer periphery of said radial impeller and guides a flow of a fluid coming out of said radial impeller so that it is directed outward to recover static pressure, and a diffuser vane formed on said diffuser; characterized in that said diffuser vane is formed so that a vane outlet diameter at a side plate end of a single stage or a plurality of stages of said diffuser is larger than a vane outlet diameter at a core plate end, said diffuser vane is formed so that a vane inlet diameter at the side plate end of the single stage or the plurality of stages of said diffuser is larger than a vane inlet diameter at the core plate end, and a vane at the side plate end of said diffuser vane is shaped so that it is inclined in a direction, in which said impeller rotates, with respect to a vane at the core plate end.

22. A centrifugal type fluid machine comprising: a radial impeller which is attached to a main shaft and which rotates together with said main shaft, a diffuser which is located on an outer periphery of said radial impeller and guides a flow of a fluid coming out of said radial impeller so that it is directed outward to recover static pressure, and a diffuser vane formed on said diffuser; characterized in that said diffuser vane is formed so that a vane outlet angle at a side plate end of a single stage of a plurality of stages of said diffuser is larger than a vane outlet angle at a core plate end, said diffuser vane is formed so that a vane outlet diameter at the side plate end of the single stage or the plurality of stages of said diffuser is larger than a vane outlet diameter at the core plate end, a vane curve at a pressure surface end of the single stage or the plurality of stages of said diffuser is formed so that it has the same radius of curvature at the side plate end and at the core plate end, while the vane curve at a negative pressure surface end is formed to have a radius of curvature so that the vane thickness at the core plate end is larger than that at the side plate end, said diffuser vane is formed so that a vane inlet diameter at the side plate end of the single stage or the plurality of stages of said diffuser is larger than a vane inlet diameter at the core plate end, and a vane at the side plate end of said diffuser vane is shaped so that it is inclined in a direction, in which said impeller rotates, with respect to a vane at the core plate end.

23. A centrifugal type fluid machine comprising: a radial impeller which is attached to a main shaft and which rotates together with said main shaft, a diffuser which is located on an outer periphery of said radial impeller and guides a flow of a fluid coming out of said radial impeller so that it is directed outward to recover status pressure, a diffuser vane formed on said diffuser, and a stage which forms a bent passage for guiding an outward flow coming out of said diffuser to an inward flow and a return passage for gathering inward the flow coming out of said bent passage and for guiding it to an inlet of a radial impeller of the next stage, which are mounted in multiple stages in the axial direction;

characterized in that said diffuser vane is formed so that a vane outlet diameter at a side plate end of a single stage or a plurality of stages of said diffuser is larger than a vane outlet diameter at a core plate end, a vane curve at a pressure surface end of the single stage or the plurality of stages of said diffuser is formed so that it has the same radius of curvature at the side plate end and at the core plate end, while the vane curve at a negative pressure surface end is formed to have a radius of curvature so that the vane thickness at the core plate end is larger than that at the side plate end, said diffuser vane is formed so that a vane inlet diameter at the side plate end of the single stage or the plurality of stages of said diffuser is larger than a vane inlet diameter at the core plate end, and a vane at the side plate end of said diffuser vane is shaped so that it is inclined in a direction, in which said impeller rotates, with respect to a vane at the core plate end.

24. A centrifugal type fluid machine comprising: a radial impeller which is attached to a main shaft and which rotates together with said main shaft, a diffuser which is located on an outer periphery of said radial impeller and guides a flow of a fluid coming out of said radial impeller so that it is directed outward to recover static pressure, a diffuser vane formed on said diffuser, and a stage which forms a bent passage for guiding an outward flow coming out of said diffuser to an inward flow and a return passage for gathering inward a flow coming out of said bent passage and for guiding it to an inlet of a radial impeller of the next stage, which are mounted in multiple stages in the axial direction; characterized in that said diffuser vane is formed so that a vane outlet angle at a side plate end of a single stage or a plurality of stages of said diffuser is larger than a vane outlet angle at a core plate end, said diffuser vane is formed so that a vane outlet diameter at the side plate end of the single stage or the plurality of stages of said diffuser is larger than a vane outlet diameter at the core plate end, the vane curve at a pressure surface end of a single stage or a plurality of stages of said diffuser is formed so that it has the same radius of curvature at the side plate end and at the core plate end, while the vane curve at a negative pressure surface end is formed to have a radius of curvature so that the vane thickness at the core plate end is larger than that at the side plate end, and a vane at the side plate end of said diffuser vane is shaped so that it is inclined in a direction, in which said impeller rotates, with respect to a vane at the core plate end.

* * * * *